US007722035B2

(12) United States Patent
Pasuch et al.

(10) Patent No.: US 7,722,035 B2
(45) Date of Patent: May 25, 2010

(54) METHOD AND APPARATUS FOR CORRECTING THE LATERAL POSITION OF A PRINTING MATERIAL, PRINTING MATERIAL CONVEYING SYSTEM AND MACHINE PROCESSING PRINTING MATERIAL

(75) Inventors: Michael Pasuch, Walldorf (DE); Hendrik Frank, Heidelberg (DE); Helge Grandt, Sandhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 579 days.

(21) Appl. No.: 11/645,835

(22) Filed: Dec. 26, 2006

(65) Prior Publication Data

US 2007/0145667 A1 Jun. 28, 2007

(30) Foreign Application Priority Data

Dec. 23, 2005 (DE) ..... 10 2005 061 839

(51) Int. Cl.
*B65H 7/02* (2006.01)

(52) U.S. Cl. ..... 271/228; 271/226; 271/273; 271/249; 271/252

(58) Field of Classification Search ..... 271/253, 271/226, 228, 249, 252, 273
See application file for complete search history.

(56) References Cited

U.S. PATENT DOCUMENTS 5,018,462 A * 5/1991 Brocklehurst ..... 112/470.07
5,094,442 A * 3/1992 Kamprath et al. ..... 271/227
5,219,159 A * 6/1993 Malachowski et al. ..... 271/228
5,273,274 A * 12/1993 Thomson et al. ..... 271/228
5,290,027 A * 3/1994 Clanton et al. ..... 271/227
5,322,273 A 6/1994 Rapkin et al.
5,697,609 A * 12/1997 Williams et al. ..... 271/228
5,725,211 A * 3/1998 Blanchard et al. ..... 271/265.02
5,809,892 A 9/1998 Krüger et al.
6,019,365 A * 2/2000 Matsumura ..... 271/227
6,044,760 A 4/2000 Krüger
6,059,285 A * 5/2000 Suga et al. ..... 271/228
6,092,801 A 7/2000 Abbadessa et al.
6,474,634 B2 * 11/2002 Schlageter ..... 271/10.03
6,488,275 B2 * 12/2002 Schlageter ..... 271/10.01
6,533,268 B2 * 3/2003 Williams et al. ..... 271/228
6,634,521 B1 * 10/2003 Hwang ..... 221/228
6,647,884 B1 * 11/2003 La Vos et al. ..... 101/485

(Continued)

FOREIGN PATENT DOCUMENTS

DE 44 16 564 A1 11/1994

(Continued)

*Primary Examiner*—Patrick Mackey
*Assistant Examiner*—Howard Sanders
(74) *Attorney, Agent, or Firm*—Laurence A. Greenberg; Werner H. Stemer; Ralph E. Locher

(57) ABSTRACT

A method for correcting the lateral position of a printing material, includes gripping the printing material with a transport unit, rotating the transport unit in a lateral position correction angular range for correcting the lateral position of the printing material, and rotating the transport unit out of the lateral position correction angular range while retaining the correction of the lateral position of the printing material. An apparatus for correcting the lateral position of a printing material, a printing material conveying system and a machine for processing printing material, are also provided.

6 Claims, 8 Drawing Sheets

U.S. PATENT DOCUMENTS

| | | | | |
|---|---|---|---|---|
| 6,779,791 | B2 * | 8/2004 | Kawamura et al. | 271/228 |
| 7,083,167 | B2 * | 8/2006 | Barthold | 271/228 |
| 7,195,238 | B2 * | 3/2007 | Suga et al. | 271/228 |
| 7,422,209 | B2 * | 9/2008 | Hashimoto | 271/228 |
| 7,422,211 | B2 * | 9/2008 | Dejong et al. | 271/249 |
| 2003/0146567 | A1 * | 8/2003 | Williams et al. | 271/249 |
| 2005/0035528 | A1 * | 2/2005 | Suga et al. | 271/10.12 |
| 2005/0035536 | A1 * | 2/2005 | Suga et al. | 271/226 |
| 2005/0093224 | A1 | 5/2005 | Frank et al. | |

FOREIGN PATENT DOCUMENTS

| | | | | |
|---|---|---|---|---|
| DE | 44 06 740 | A1 | | 9/1995 |
| DE | 102 16 758 | A1 | | 10/2003 |
| DE | 103 51 619 | A1 | | 6/2005 |
| EP | 0 907 515 | B1 | | 4/2000 |
| EP | 1 354 833 | A2 | | 10/2003 |
| JP | 10067448 | A | * | 3/1998 |
| JP | 10167527 | A | * | 6/1998 |
| JP | 11349191 | A | * | 12/1999 |
| JP | 2005200119 | A | * | 7/2005 |

* cited by examiner

METHOD AND APPARATUS FOR CORRECTING THE LATERAL POSITION OF A PRINTING MATERIAL, PRINTING MATERIAL CONVEYING SYSTEM AND MACHINE PROCESSING PRINTING MATERIAL

CROSS-REFERENCE TO RELATED APPLICATION

This application claims the priority, under 35 U.S.C. §119, of German Patent Application 10 2005 061 839.1, filed Dec. 23, 2005; the prior application is herewith incorporated by reference in its entirety.

BACKGROUND OF THE INVENTION

Field of the Invention

The present invention relates to a method for correcting the lateral position of a printing material, which includes gripping the printing material with a transport unit. The invention also relates to an apparatus for correcting the lateral position of a printing material, a printing material conveying system and a machine for processing printing material.

Transport systems for printing materials, for example for printing material sheets, which transport the sheets through the use of an electric linear drive, are known from the prior art. There, the electric linear drive as a rule includes a primary part on each machine side. The primary part interacts in a known manner with secondary parts which are configured as runners. A transport system of that type is described, for example, in German Published, Non-Prosecuted Patent Application DE 103 51 619 A1, corresponding to U.S. Patent Application Publication No. US 2005/0093224 A1.

Furthermore, it is known to correct the position of erroneously oriented sheets which deviate from a setpoint or desired position, for example in the conveying direction, in the lateral direction or in their angular position, through the use of register adjusting apparatuses.

German Published, Non-Prosecuted Patent Application DE 44 06 740 A1 describes an apparatus for register correction in a sheet-fed printing press, having sheet holders which are disposed in such a way that they can be displaced by motor. The sheet-fed printing press permits positional correction both in the conveying direction as well as transversely with respect to the conveying direction of the sheets. There, for example, linear motors can be used as actuators for a carriage which carries the sheet holders. In order to carry out diagonal sheet correction, that is to say in order to correct the angular position of the sheet, the sheet is oriented on additional front lays before it is gripped by the apparatus, that is to say the diagonal sheet correction is not possible only with the apparatus for register correction and without the additional front lays. Pivoting of the carriage is not described.

European Patent EP 0 907 515 B1, corresponding to U.S. Pat. Nos. 5,809,892; 6,044,760; and 6,092,801, describes a sheet transport system for a rotary printing press having first and second advance elements which are configured as runners of an electric linear drive and drive sheet transport apparatuses which have sheet holding devices. The sheet holding devices can be fastened to a crossmember which is connected in an articulated manner to the advance elements. In order to set the diagonal register of the transported sheets, the advance elements can be controlled and regulated independently of one another, with the result that the relative position between the advance elements can be changed. Correction of the lateral register of the sheets is not described.

German Published, Non-Prosecuted Patent Application DE 102 16 758 A1, corresponding to European Patent EP 1 354 833 B1, describes a method for orienting sheets according to the side edge, having a gripper system in a feed cylinder. The gripper system can be moved laterally, that is to say in the axial direction. In order to carry out diagonal register correction, additional front lays are provided as in German Published, Non-Prosecuted Patent Application DE 44 06 740 A1. Pivoting of the gripper system is not described.

German Patent DE 44 16 564 C2, corresponding to U.S. Pat. No. 5,322,273, describes a sheet orienting apparatus for diagonal and lateral register correction through the use of three rollers which are driven by respective stepping motors and are segmented in the circumferential direction. Pivoting of the apparatus is not described.

SUMMARY OF THE INVENTION

It is accordingly an object of the invention to provide a method for correcting the lateral position of a printing material, which overcomes the hereinafore-mentioned disadvantages of the heretofore-known methods of this general type.

It is another object of the present invention to provide an improved method for correcting the lateral position of a printing material, in which the movement of a transport unit for the printing material at the same time brings about the correction of the lateral position. It is a further object of the present invention to provide a printing material conveying system having an alternative use. It is an alternative object of the present invention to provide an improved apparatus for correcting the position of a printing material in the lateral direction. It is an additional object of the present invention to provide an improved apparatus for correcting the position of a printing material in the lateral direction, in which the number of required actuators and the associated costs are kept low.

With the foregoing and other objects in view there is provided, in accordance with the invention, a method for correcting a position of a printing material. The method comprises correcting a lateral position of the printing material by gripping the printing material with a transport unit, rotating the transport unit in a lateral position correction angular range for correcting the lateral position of the printing material, and rotating the transport unit out of the lateral position correction angular range while retaining the correction of the lateral position of the printing material.

Before the transport unit is rotated in the lateral position correction angular range, the transport unit is rotated first of all into the lateral position correction angular range (if it has not already taken place). In comparison with the prior art, the correction of the lateral position of the printing material is advantageously brought about by rotation of the transport unit. The rotation of the transport unit can preferably be achieved by a relative movement of two runners of an electric linear drive which moves the transport unit in a transport direction. This results in the advantage that the actuators which are present in any case, that is to say the drive of the transport unit, can also be used, apart from using it to move the printing material, to correct its position, in particular the lateral position and circumferential position.

In accordance with another mode of the invention, in order to correct the lateral position and the angular position of the printing material, the transport unit is moved into the angular position of the printing material and grips the printing material. The transport unit is rotated in the lateral position correction angular range for correcting the lateral position of the printing material. The transport unit is rotated out of the lateral position correction angular range, while retaining the correction of the lateral position of the printing material and correcting the angular position of the printing material. The rotation of the transport unit into two different angular positions (angular position of the printing material, angle within the lateral position correction angular range) and back into the starting position, which rotation is brought about by the actuators that are present in any case and is sequential, advantageously permits the correction both of the lateral position and of the angular position. Correction of the position of the printing material in the transport direction is likewise possible by way of the actuators for moving the printing material.

In accordance with a further mode of the invention, at the beginning of the method, the transport unit is situated in a starting position which is perpendicular with respect to the transport direction, and the transport unit is rotated out of the lateral position correction angular range into the starting position.

In accordance with an added mode of the invention, the transport unit includes a crossmember which, during rotation of the transport unit in the lateral position correction angular range in a first angular direction, performs a translation in the longitudinal direction of the crossmember. According to this mode of the invention, the relative longitudinal movement of the actuators can advantageously be converted into a rotational movement of the transport unit and, further, into a sideways movement of the crossmember.

In accordance with an additional mode of the invention, the transport unit includes a crossmember which, during rotation of the transport unit out of the lateral position correction angular range in a second angular direction, is stationary translationally in the longitudinal direction of the crossmember. The second angular direction is opposed to the first angular direction. According to this mode of the invention, the relative longitudinal movement of the actuators can advantageously be converted into a rotational movement of the transport unit, with the crossmember being stationary in the lateral direction.

In accordance with yet another mode of the invention, the transport unit is rotated by a relative movement of two runners of an electric linear drive of a printing material conveying system.

With the objects of the invention in view, there is also provided a printing material conveying system. The system comprises an electric linear drive including a transport unit for a printing material having two runners and a crossmember. The electric linear drive corrects a lateral position of the printing material by a relative movement of the two runners.

In comparison with the prior art, the correction of the lateral position of the printing material is not brought about by a lateral, uniformly oriented movement of the actuators, but can advantageously be brought about by a relative movement in the transport direction of the actuators which are present in any case. According to the invention, the printing material conveying system is used in a multifunctional manner: firstly for transport, secondly for lateral position correction.

In accordance with another feature of the invention, in order to correct the lateral position and the angular position of the printing material, the correction is carried out by a relative movement of the two runners. According to this feature of the invention, correction both of the lateral position and of the angular position of the printing material can be brought about by a relative movement in or counter to the transport direction of the actuators which are present in any case. As a consequence, the printing material conveying system is used in a multifunctional manner: firstly for transport, secondly for lateral and angular position correction.

With the objects of the invention in view, there is additionally provided an apparatus for correcting a position of a printing material in a lateral direction. The apparatus comprises an electric linear drive having at least two runners to be moved substantially perpendicularly relative to the lateral direction.

In contrast to the prior art, the runners which act as actuators are advantageously not moved parallel to the lateral direction but perpendicularly with respect thereto, preferably in a transport direction of the linear drive.

In accordance with a further feature of the invention, the runners of the electric linear drive can be moved relative to one another.

With the objects of the invention in view, there is concomitantly provided a machine for processing printing material, in particular a printing press, a sheet-processing rotary printing press for lithographic offset printing or a sheet-processing punch, comprising the apparatus according to the invention.

Other features which are considered as characteristic for the invention are set forth in the appended claims.

Although the invention is illustrated and described herein as embodied in a method and an apparatus for correcting the lateral position of a printing material, a printing material conveying system and a machine for processing printing material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
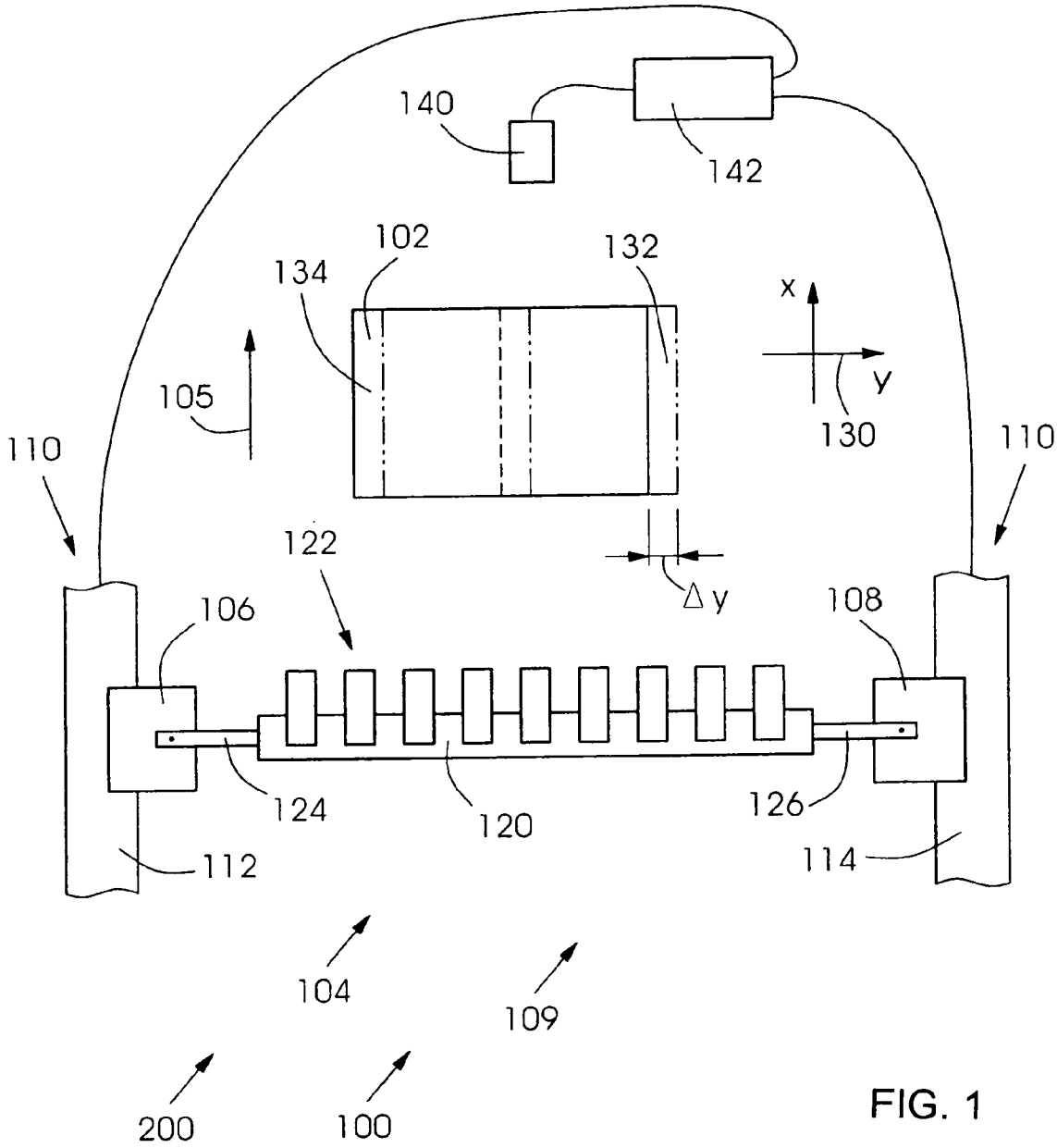
FIG. 1 is a fragmentary, diagrammatic top-plan view of one exemplary embodiment of an apparatus for carrying out the method according to the invention for correcting a lateral position.

Referring now in detail to the figures of the drawings, in which features which are identical or correspond to one another are provided with the same designations in each case and first, particularly, to FIG. 1 thereof, there is seen an exemplary embodiment of an apparatus 100 of a conveying system 200 for printing material. The apparatus 100 can be used for carrying out the method according to the invention for correcting the lateral position of a printing material 102, for example a paper or cardboard sheet. The apparatus 100 includes a transport unit 104 (which is situated in its starting position 109 in FIG. 1) that can be moved in a transport direction 105 (x-direction) and has secondary parts on both sides which are configured as runners 106, 108 of an electric linear drive 110 that includes primary parts 112, 114. The transport unit 104 includes a crossmember 120 which has holding elements 122, for example clamping or sucking grippers, for holding the printing material 102, and is connected to the runners 106, 108 in an articulated manner through connecting elements 124, 126. In order to compensate for a change in the spacing of the two runners from one another, the connecting elements 124, 126 are disposed, for example, displaceably in the crossmember 120, with the result that one runner can lead or trail the other and the crossmember can be rotated in this way.

As is shown in FIG. 1, the printing material 102 is offset in the lateral direction 130 (axial or y-direction) by an amount $\Delta y$ with respect to a setpoint or desired position 132, with the result that lateral register correction, that is to say correction of the lateral position, has to be carried out.

Furthermore, FIG. 1 shows a recording unit 140, for example an optical camera or a sensor system having an associated non-illustrated image processing and evaluation system. The recording unit 140 determines an actual position 134 of the printing material 102, and determines correction values for the necessary register correction from a comparison with the predefined setpoint position 132 and transfers them to a control unit 142 which controls the movement of the two runners 106, 108 of the electric linear drive 110.

Figure 2:
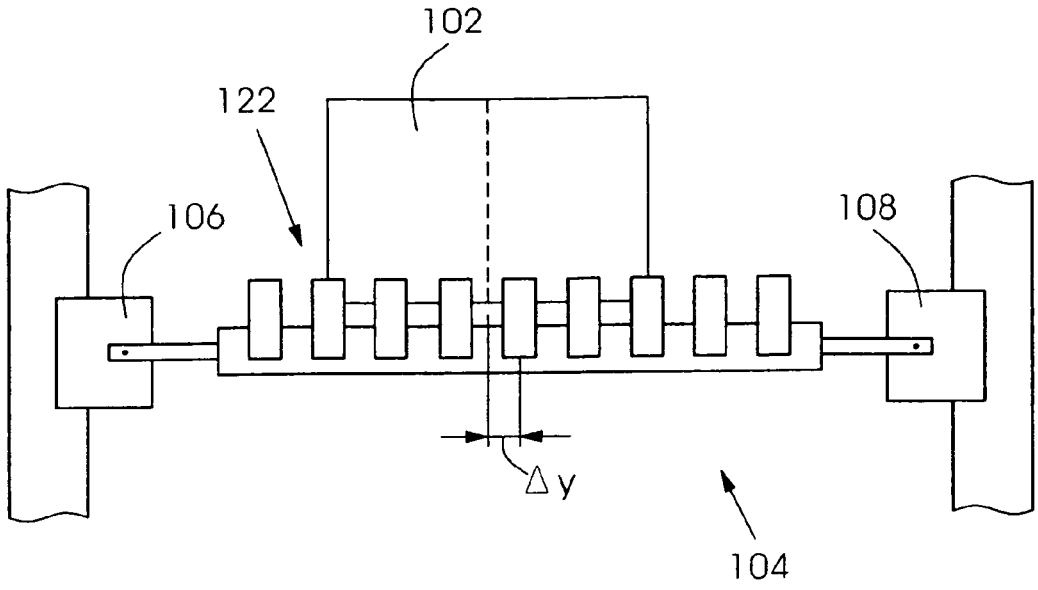
FIG. 2 is a top-plan view of the embodiment which is shown in FIG. 1, during the performance of the method according to the invention.

FIG. 2 shows how the printing material 102 is first of all gripped by the transport unit 104, that is to say by the holding elements 122 of the transport unit 104. It can be seen, for example as a result of the dashed center line of the printing material 102, that the printing material 102 is gripped by the holding elements 122 in a configuration offset by an amount $\Delta y$ toward the runner 106 with regard to the center between the two runners 106, 108.

Figure 3:
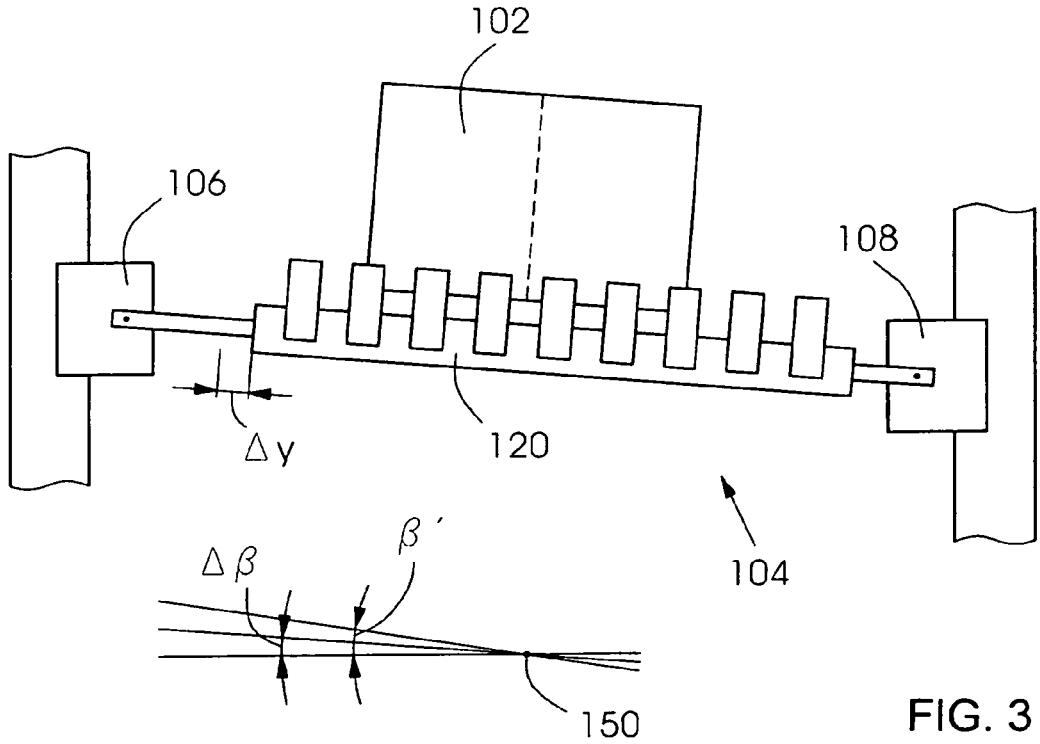
FIG. 3 is a top-plan view of the embodiment which is shown in FIG. 1, during the performance of the method according to the invention.

FIG. 3 shows how the transport unit 104 and the printing material 102 which is gripped by it are rotated as a result of a relative movement of the two runners 106, 108 by an angle $\Delta\beta$ about an axis 150 perpendicularly with respect to the movement plane of the printing material 102. During rotation of the transport unit 104 in an angular region which is referred to as a lateral position correction angular range $\beta'$, the correction of the lateral position of the printing material 102 is carried out, that is to say the crossmember 120 is moved together with the printing material 102 during rotation in the lateral position correction angular range $\beta'$ in the lateral direction toward one of the two runners 106, 108. It can be seen that the crossmember 120 is displaced laterally by the correction value $\Delta y$ in the direction of the runner 108 in FIG. 3, in comparison with the illustration in FIG. 2.

Figure 4:
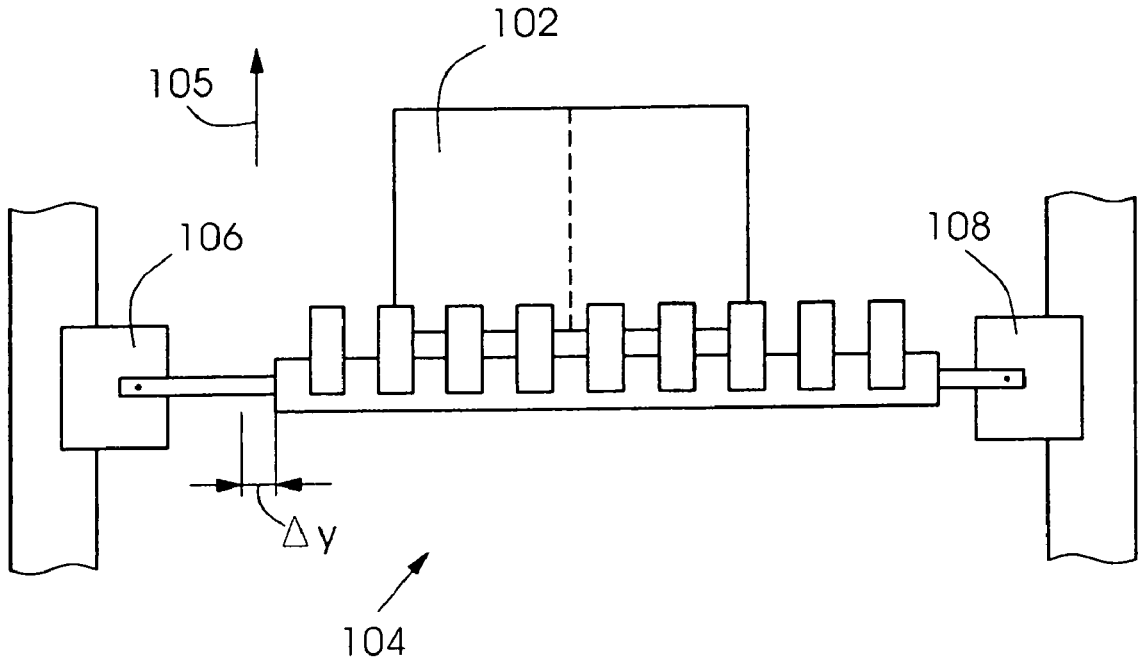
FIG. 4 is a top-plan view of the embodiment which is shown in FIG. 1, during the performance of the method according to the invention.

The illustration in FIG. 4 shows how the transport unit 104 is rotated out of the lateral position correction angular range $\beta'$ about the axis 150 back in a direction which is perpendicular with respect to the transport direction 105 of the printing material 102. In this rotation of the transport unit 104, the previously performed correction of the lateral position of the printing material 102 by $\Delta y$ is retained, with the result that the printing material 102 is then oriented correctly with regard to the center between the two runners 106, 108, that is to say it is situated in lateral register. According to the invention, the correction of the lateral position of the printing material 102 is achieved by rotation or pivoting of the transport unit 104, with the crossmember 120 moving in the lateral direction toward one runner. When the transport unit 104 is rotated back, according to the invention, in contrast the crossmember 120 is not moved in the lateral direction, that is to say it is stationary in the lateral direction. In this way, the apparatus for carrying out the method according to the invention advantageously requires only the two runners 106, 108, which are present in any case for transporting the printing material, of the electric linear drive 110, as actuators. Further actuators which would be provided only for lateral orientation can therefore advantageously be omitted.

Figure 5:
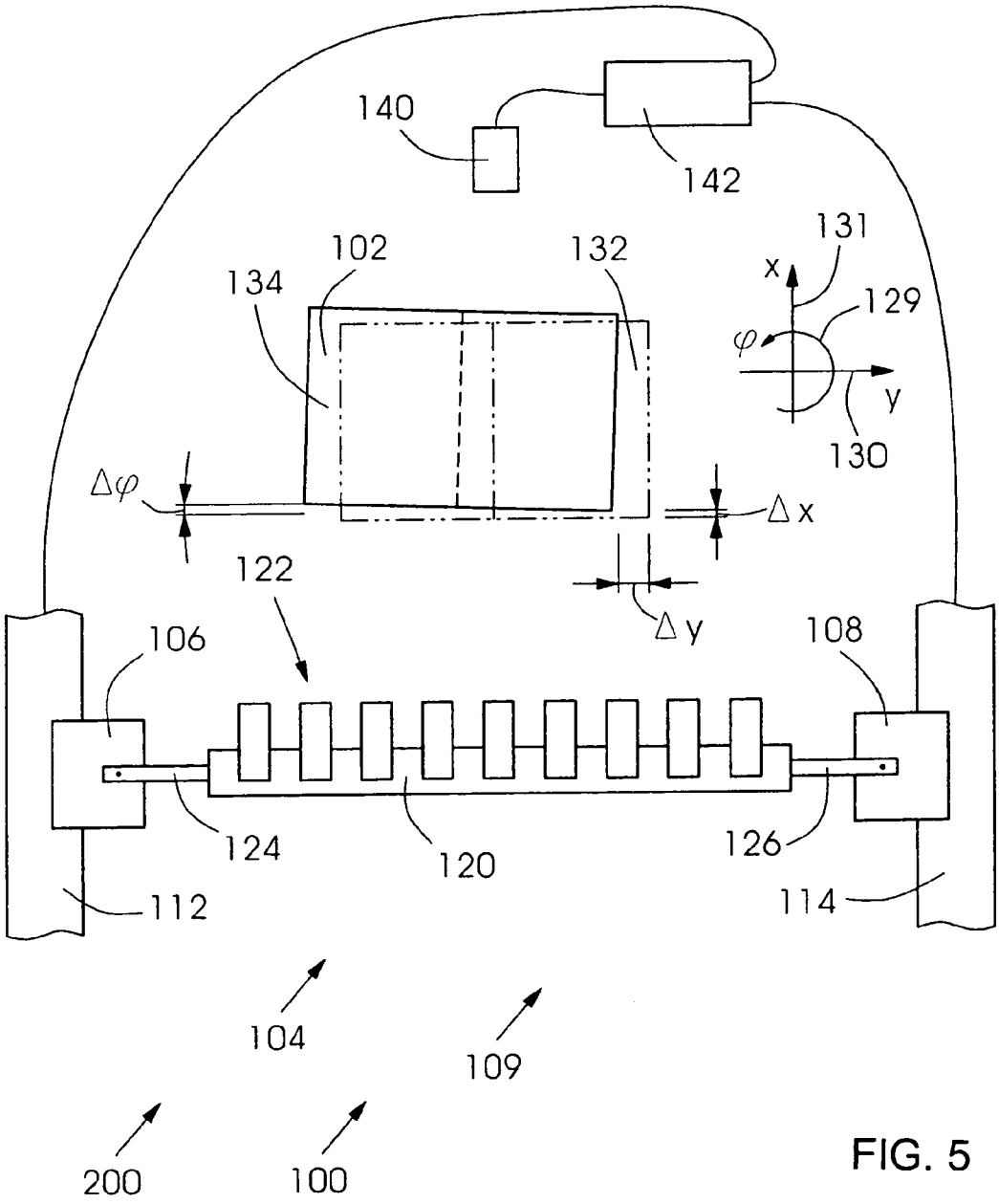
FIG. 5 is a top-plan view of one embodiment of an apparatus for carrying out the method according to the invention for correcting the lateral and angular position.

FIG. 5 shows one exemplary embodiment of an apparatus 100 of a conveying system 200 for printing material, for example in a printing press, in its starting position 109. The apparatus 100 can be used for carrying out the method according to the invention for correcting the lateral position and the angular position of a printing material 102. The construction of the apparatus 100 corresponds to that of the apparatus which is shown in FIG. 1. The printing material 102 is offset in the lateral direction 130 (axial or y-direction) by an amount $\Delta y$ and in the angular direction 129 (diagonal or $\phi$-direction) by an angular amount $\Delta\phi$ with respect to the setpoint or desired position 132. In addition, the printing material 102 is also offset in the movement direction 131 (longitudinal or x-direction) by an amount $\Delta x$. Correction of the position of the printing material 102 in the movement direction 131 is made possible in a simple manner by way of the apparatus which is shown in FIG. 1 and in FIG. 5, by simultaneous movement of the runners 106, 108 in or counter to the movement direction 131.

In addition to the correction of the position of the printing material 102 in the movement direction 131, that is to say in addition to what is known as circumferential register correction, lateral register correction and correction of the angular position, that is to say what is known as diagonal sheet correction, are therefore required. For this purpose, the actual position 134 of the sheet 102 is determined by using the recording unit 140 and, as in the example which is shown in FIG. 1, correction values for the necessary register corrections are determined from a comparison with a setpoint or desired position 132 and made available to the control unit 142 for controlling the movement of the two runners 106, 108.

Figure 6:
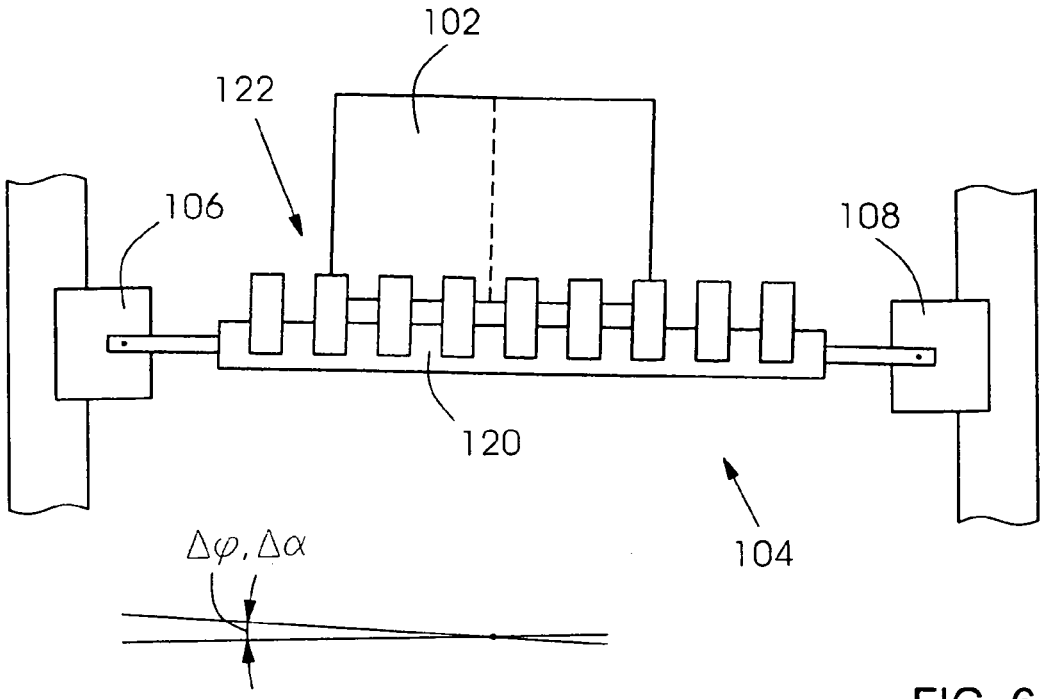
FIG. 6 is a top-plan view of the embodiment which is shown in FIG. 5, during the performance of the method according to the invention.

FIG. 6 shows how the transport unit 104 and therefore the crossmember 120 are first of all rotated by a relative movement of the two runners 106, 108 with respect to one another by a correction angle $\Delta\phi$ into the angular position of the printing material 102, and how the holding elements 122 grip the printing material 102 in the angular position. During gripping of the printing material 102, the crossmember 120 and the printing material 102, that is to say its front edge, are therefore oriented substantially in parallel.

Figure 7:
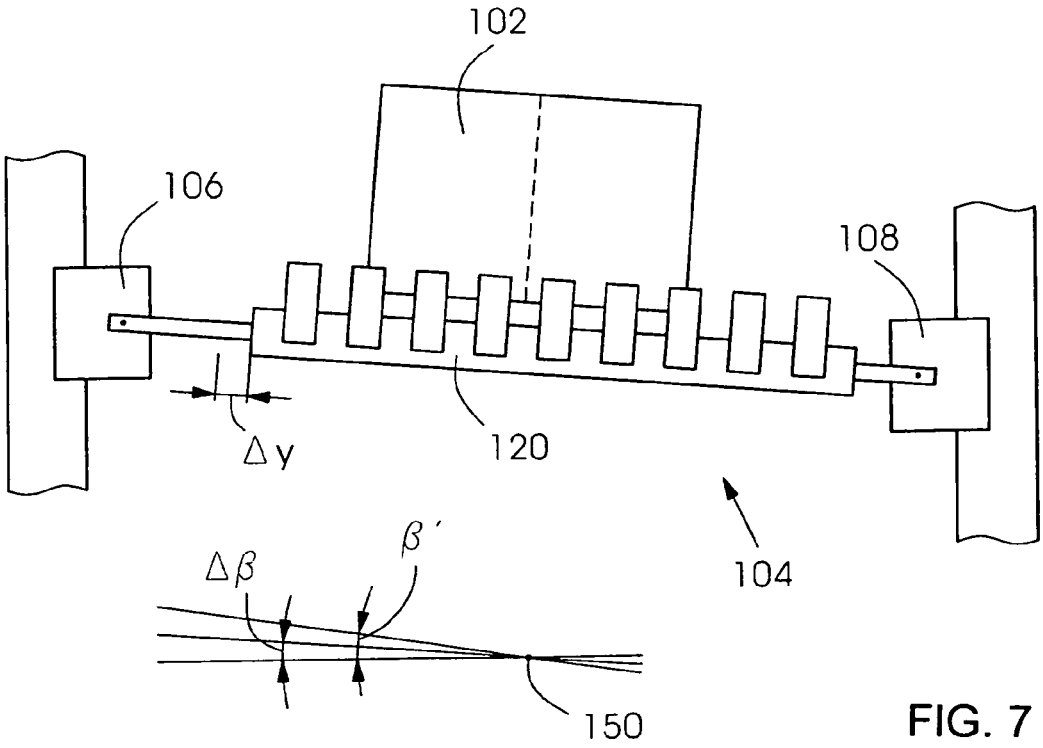
FIG. 7 is a top-plan view of the embodiment which is shown in FIG. 5, during the performance of the method according to the invention.

FIG. 7 shows the method step which follows the gripping of the printing material 102. The transport unit 104 and the printing material 102 which is gripped by it are rotated by an angle $\Delta\beta$ about the axis 150 in the lateral position correction angular range $\beta'$ ($\Delta\beta$ is defined herein in a manner which starts from the position of the crossmember 120 in the position which is shown in FIG. 6) by a further relative movement of the two runners 106, 108 with respect to one another. In this case, the crossmember 120 and the printing material 102 are moved in the lateral direction y by $\Delta y$ and the lateral register is therefore corrected.

Figure 8:
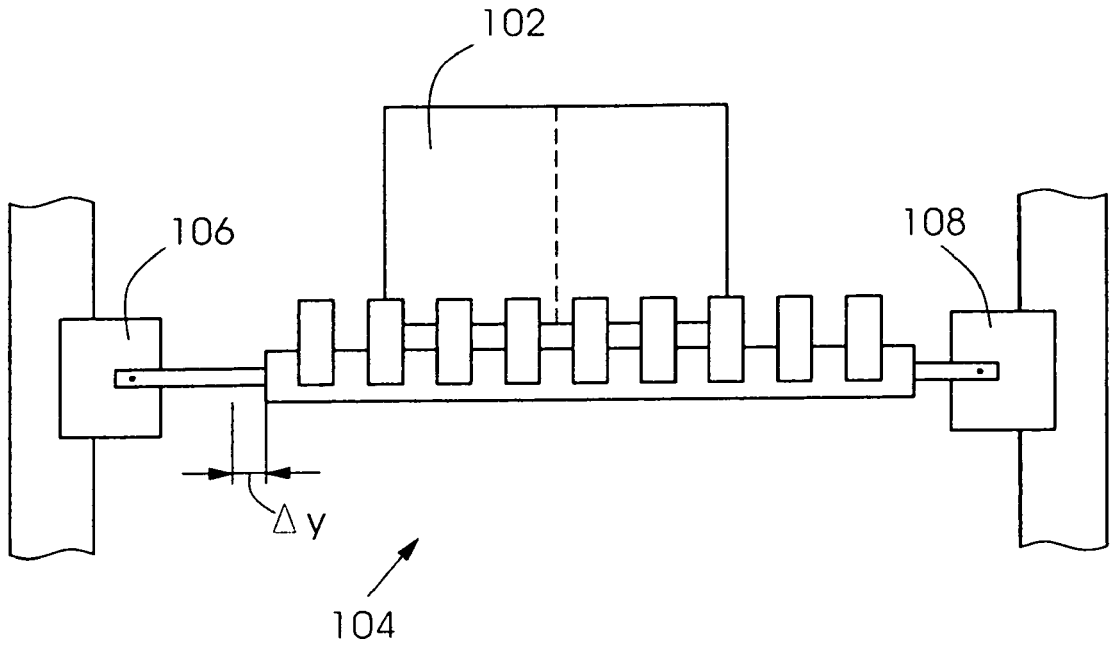
FIG. 8 is a top-plan view of the embodiment which is shown in FIG. 5, during the performance of the method according to the invention.

In addition to the lateral register correction, the transport unit 104 is rotated back again into a position (starting position 109) which is perpendicular with respect to the transport direction 105 of the printing material 102, as is shown in FIG. 8. The correction of the lateral position of the printing material 102 is retained and the angular position is corrected.

According to the invention, the correction of the lateral position and the angular position of the printing material 102 is achieved by rotation or pivoting of the transport unit 104, with the crossmember 120 moving in the lateral direction toward one runner. In contrast, during the rotation back of the transport unit 104, according to the invention, the crossmember 120 is not moved in the lateral direction, that is to say it is stationary in the lateral direction. In this way, the apparatus for carrying out the method according to the invention advantageously requires only the two runners 106, 108, which are present in any case for transporting the printing material, of the electric linear drive 110 as actuators. Further actuators which would be provided only for the lateral orientation can therefore advantageously be omitted.

Figure 9:
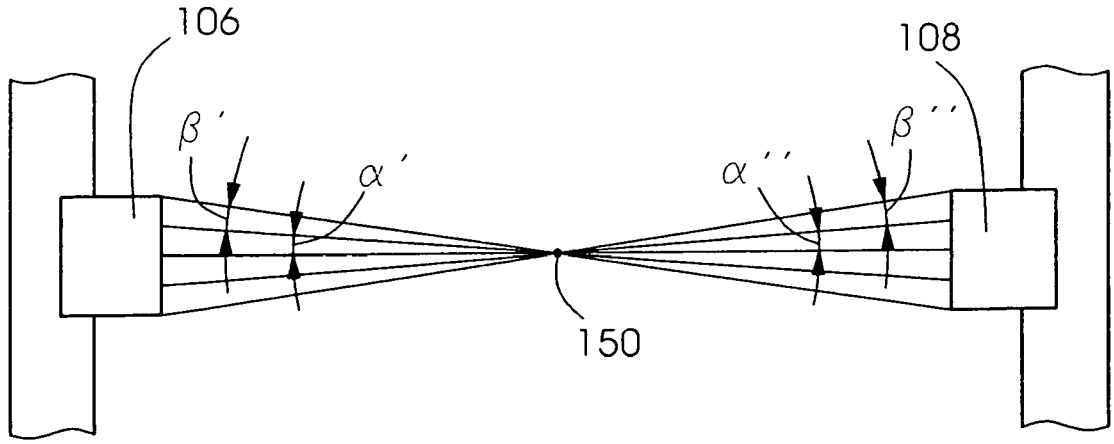
FIG. 9 is a top-plan view showing angular ranges which are approached by the transport unit during the performance of the method according to the invention.

FIG. 9 diagrammatically shows the correction angular ranges $\alpha'$, $\alpha''$ and $\beta'$, $\beta''$, into which the transport unit 104 can be rotated. An angular position correction angle $\Delta\alpha$ for diagonal sheet correction therefore lies, depending on the sign of the correction angle $\Delta\phi$, in the angular position correction angular range $\alpha'$ or $\alpha''$. A lateral position correction angle $\Delta\beta$ for lateral register correction therefore lies, depending on the sign of the correction value $\Delta y$, in the lateral position correction angular range $\beta'$ or $\beta''$.

If the transport unit 104 is rotated by an angle $0<|\phi|<|\alpha'|$ or $0<|\phi|<|\alpha''|$, only the angular position of the transport unit 104 and the crossmember 120 is changed, but not the lateral position of the crossmember 120.

If the transport unit 104 is rotated by an angle $|\alpha'|<|\phi|<|\beta'|$ or $|\alpha''|<|\phi|<|\beta''|$, a lateral movement of the crossmember 120 and therefore lateral register correction are initiated after the limiting angle $\alpha'$ or $\alpha''$ has been swept through, that is to say the angular movement is converted into a translational lateral movement of the crossmember 120. In addition, if angle $\phi=\beta'$ or $\phi=\beta''$, a mechanical stop can be provided to prevent further rotation.

During rotation back of the transport unit 104 and the crossmember 120, the previously set lateral register correction is maintained.

The lateral register correction can take place in such a way that the printing material is displaced by the apparatus according to the invention depending on the lateral offset (left or right) of the printing material in the direction of the runner 106 or the runner 108. In this case, an adjusting movement of the crossmember is provided in the angular position correction angular ranges $\beta'$ and $\beta''$. However, there can also be provision for the printing material to always be displaced only in the direction of one of the two runners 106 or 108. In this case, an adjusting movement of the crossmember in one of the angular position correction angular ranges $\beta'$ or $\beta''$ is sufficient, as long as the crossmember is situated in an off-center lateral position when the procedure begins.

The conversion of the rotational movement of the transport unit 104 into a translational movement of the crossmember 120 can be achieved, for example, through a gear mechanism which is configured suitably and is coupled to the runners and the crossmember.

Figure 10:
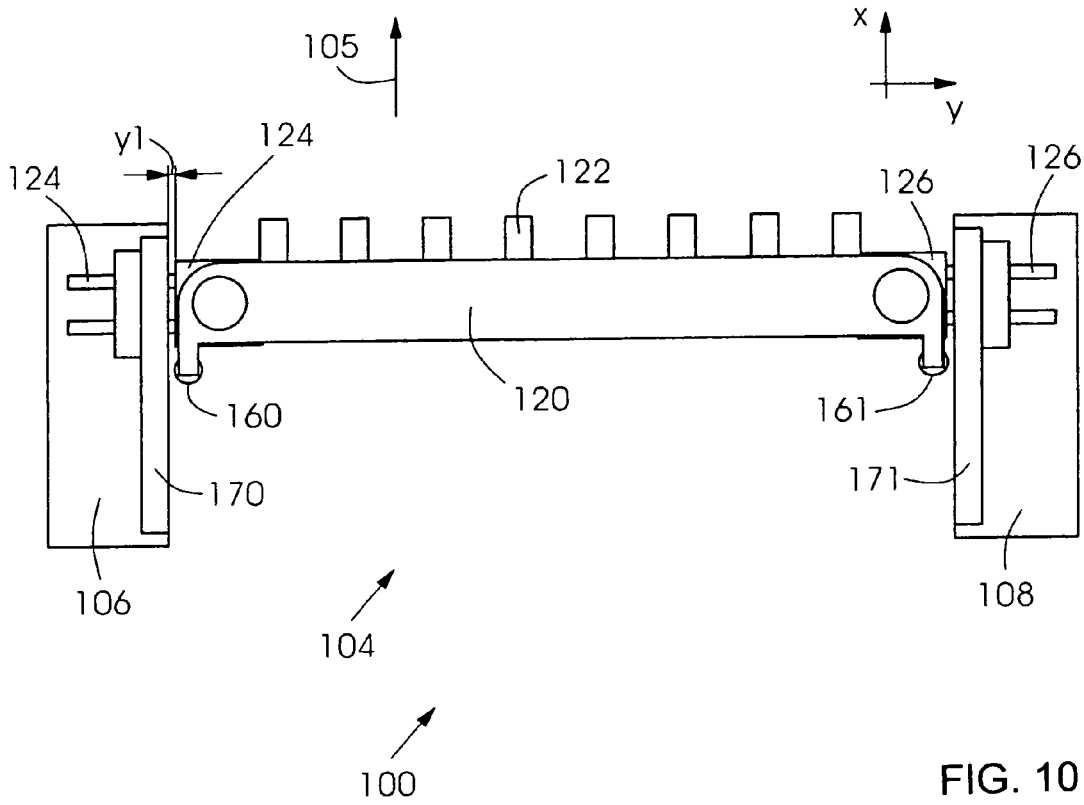
FIG. 10 is a top-plan view of one embodiment of an apparatus for carrying out the method according to the invention for correcting the lateral and angular position.

The apparatus 100 which is shown in FIG. 10 includes a transport unit 104 which can be moved in the transport direction 105 and has secondary parts which are configured as runners 106, 108 on both sides. The transport unit 104 includes a crossmember 120 which has holding elements 122, for example clamping or sucking grippers, for holding the printing material, and is connected to the connecting elements 124, 126 through a rotary joint. The degree of freedom of the rotary joint is located exclusively in the x-y plane. In order to compensate for the change in the spacing of the crossmember 120 from the runners 106, 108, the connecting elements 124, 126 are disposed displaceably in the runners 106, 108, with the result that one runner can lead or trail with respect to the other and the crossmember can be rotated in this way. The connecting elements 124, 126 are kept in their position through the use of a clamping force in the runners 106, 108, as a result of which the crossmember 120 remains in an accurate position during operation.

Figure 11:
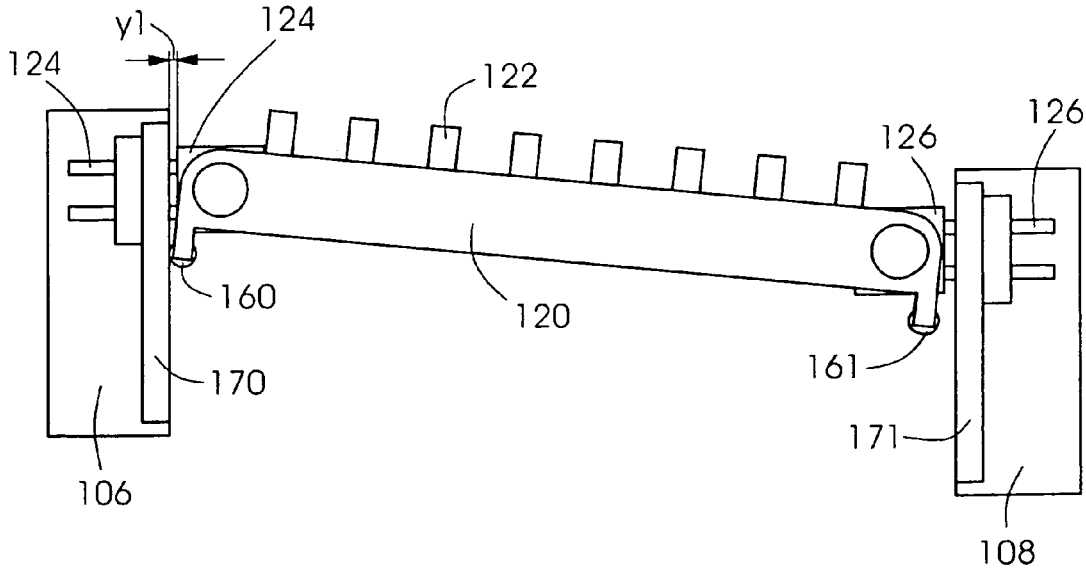
FIG. 11 is a top-plan view of the embodiment which is shown in FIG. 10, during the performance of the method according to the invention.

In order to provide for the correction (shown in FIG. 11) of the angular position, that is to say what is known as diagonal sheet correction, of a printing material, a defined spacing is provided between pressure rollers 160, 161 of the crossmember 120 and supporting elements 170, 171 of the runners 106, 108. As a result, rotation of the crossmember 120 is possible until contact of the pressure roller 160 with the associated supporting element 170, for example. The rotation is realized through leading or trailing of the runners 106, 108.

Figure 12:
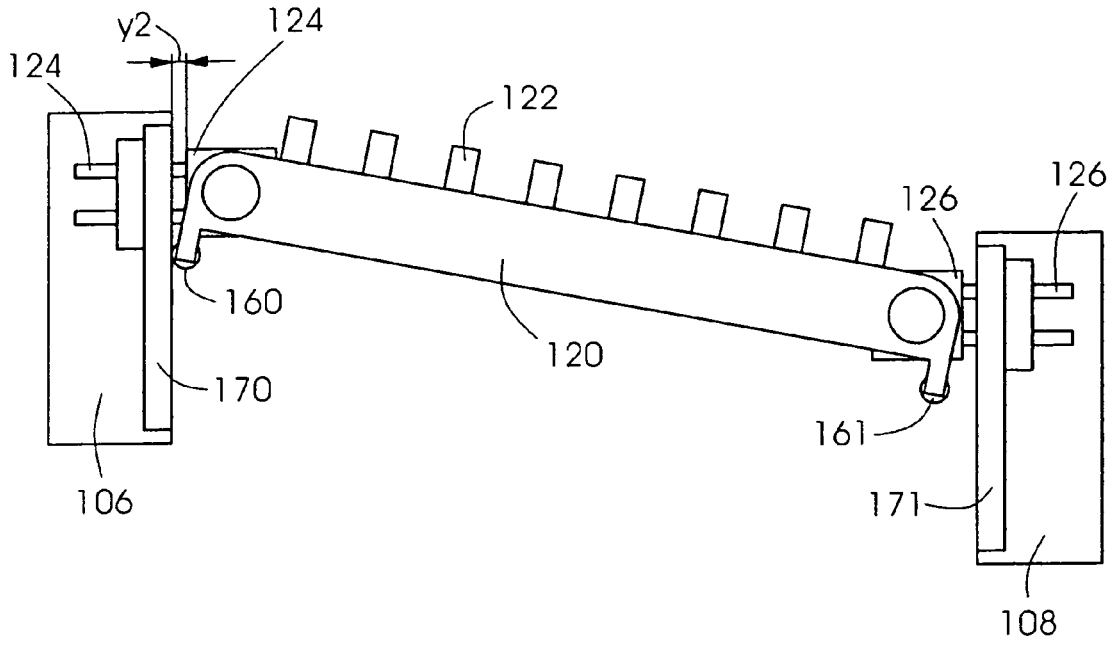
FIG. 12 is a top-plan view of the embodiment which is shown in FIG. 10, during the performance of the method according to the invention.

In the correction (shown in FIG. 12) of the lateral position of the printing material, the crossmember 120 is rotated by the relative movement of one of the two runners, for example the runner 106. If, for example, the pressure roller 160 then bears against the supporting element 170 of the runner 106 and the runner 106 moves further in the movement direction, the rotational angle of the crossmember 120 is increased. The force which is introduced into the pressure roller 160 has to be greater than the clamping force of the connecting element 124. If this is the case, the connecting element 124 is displaced and therefore sets a displaced lateral position of the crossmember.

Figure 13:
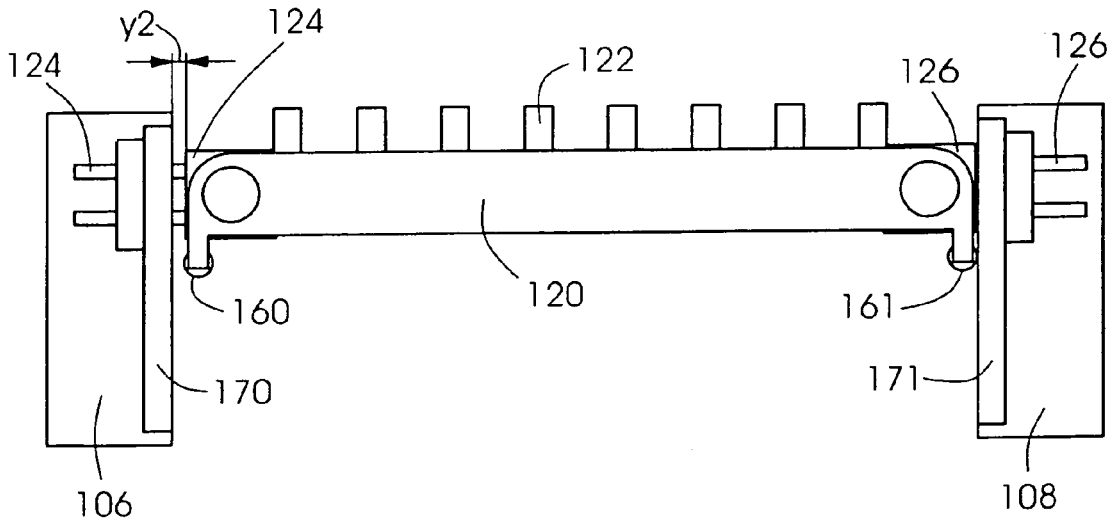
FIG. 13 is a top-plan view of the embodiment which is shown in FIG. 10, during the performance of the method according to the invention.

The crossmember 120 is moved into its angle-side zero position again by the trailing (shown in FIG. 13) of the runner 108. The crossmember 120 is held in its displaced position by the clamping force and no further introduction of forces.

It can be gathered from FIGS. 10 to 13 that the lateral spacing y2 between the crossmember 120 and the runner 106 is greater than the lateral spacing y1 before the correction process, and that a lateral displacement has therefore taken place.

We claim:

1. A method for correcting a position of a printing material, the method comprising the following steps:

correcting a lateral position of the printing material by:

initially placing a transport unit in a starting position being substantially perpendicular to a transport direction of the printing material;

gripping the printing material with the transport unit;

rotating the transport unit angularly in a lateral position correction angular range for correcting the lateral position of the printing material; and rotating the transport unit angularly out of the lateral position correction angular range into the starting position while maintaining the gripping of the printing material, and while retaining the correction of the lateral position of the printing material.

2. The method according to claim 1, which further comprises correcting the lateral position and an angular position of a printing material by:

moving the transport unit into an angular position of the printing material and gripping the printing material;

correcting the angular position of the printing material by the rotating of the transport unit out of the lateral position correction angular range into the starting position.

3. The method according to claim 1, which further comprises:

providing the transport unit with a crossmember having a longitudinal direction; and during rotation of the transport unit in the lateral position correction angular range in an angular direction, performing a translation of the crossmember in the longitudinal direction.

4. The method according to claim 1, which further comprises:

providing the transport unit with a crossmember having a longitudinal direction; and during rotation of the transport unit out of the lateral position correction angular range in an angular direction, the crossmember being stationary translationally in the longitudinal direction.

5. The method according to claim 1, which further comprises:

providing the transport unit with a crossmember having a longitudinal direction;

during rotation of the transport unit in the lateral position correction angular range in a first angular direction, performing a translation of the crossmember in the longitudinal direction; and during rotation of the transport unit out of the lateral position correction angular range in a second angular direction, the crossmember being stationary translationally in the longitudinal direction, the second angular direction being opposed to the first angular direction.

6. The method according to claim 1, which further comprises rotating the transport unit by a relative movement of two runners of an electric linear drive of a printing material conveying system.

* * * * *